US008106857B2

(12) United States Patent
Tsai et al.

(10) Patent No.: US 8,106,857 B2
(45) Date of Patent: Jan. 31, 2012

(54) LIGHT DRIVING DEVICE

(75) Inventors: Jung-Yuan Tsai, Taoyuan (TW); Kuo-Feng Chen, Taoyuan (TW); Ching-Hao Tseng, Taoyuan (TW)

(73) Assignee: HTC Corporation, Taoyuan (TW)

( * ) Notice: Subject to any disclaimer, the term of this patent is extended or adjusted under 35 U.S.C. 154(b) by 1052 days.

(21) Appl. No.: 11/808,393

(22) Filed: Jun. 8, 2007

(65) Prior Publication Data

US 2008/0007419 A1 Jan. 10, 2008

(30) Foreign Application Priority Data

Jun. 9, 2006 (TW) ..... 95120599 A

(51) Int. Cl.
*G09G 3/30* (2006.01)

(52) U.S. Cl. ..... 345/76; 345/82; 315/169.3

(58) Field of Classification Search ..... 345/76–83, 345/204; 315/169.3
See application file for complete search history.

(56) References Cited

U.S. PATENT DOCUMENTS 5,633,651 A * 5/1997 Carvajal et al. ..... 345/82
5,739,710 A * 4/1998 Baik ..... 327/173
6,269,468 B1 7/2001 Dean et al.
7,129,654 B2 * 10/2006 Tsai et al. ..... 315/312
7,259,525 B2 * 8/2007 Yang ..... 315/291
2002/0003511 A1 * 1/2002 Havel ..... 345/39
2002/0140380 A1 10/2002 Biebl
2002/0191416 A1 12/2002 Wesson
2004/0150355 A1 8/2004 Tani et al.
2005/0044275 A1 * 2/2005 Adamson et al. ..... 709/253
2005/0218838 A1 10/2005 Lys
2006/0033456 A1 * 2/2006 Tsai et al. ..... 315/312
2007/0097043 A1 * 5/2007 Yang ..... 345/82
2007/0097044 A1 * 5/2007 Yang ..... 345/82

FOREIGN PATENT DOCUMENTS

EP 1246511 A1 10/2002
EP 1656001 A1 5/2006
TW I226030 B 1/2005
TW M263598 U 5/2005

OTHER PUBLICATIONS

Gong Changiai, "Design of Intelligent First Signal Discriminator Based on Single Chip Microcomputer", Mar. 31, 2003.

* cited by examiner

*Primary Examiner* — Jason Mandeville
(74) *Attorney, Agent, or Firm* — Birch, Stewart, Kolasch & Birch, LLP

(57) ABSTRACT

A light driving device comprises a signal generator, a demultiplexer and a light driving circuit. The signal generator generates a signal. The demultiplexer converts the signal to at least a control signal. The light driving circuit is controlled by the control signal.

5 Claims, 6 Drawing Sheets

LIGHT DRIVING DEVICE

BACKGROUND OF THE INVENTION

1. Field of the Invention

The invention relates to a light driving device and, in particular, to a light driving device and a light driving method for alternately driving lights with a single signal.

2. Description of the Related Art

In various electronic devices, lights are often used to indicate different states thereof. Different light signals are required according to different applications of the electronic devices. As a result, light driving devices are required to control flashing, i.e. ON and OFF states, of the lights.

There are two methods generally used to drive lights. The first one, as shown in FIG. 1, is that control signals of light emitting diodes (LEDs) are provided by a general purpose input/output (GPIO) of a central processing unit (CPU), and duty cycles and periods of the control signals are determined by programs and counters inside the CPU.

The second one, as shown in FIG. 2, is that an LPG controller for providing control signals of LEDs is built into a CPU, in which there are some adjustable parameters such as ON/OFF, frequency, duty cycle, etc., and durations and periods of the control signals are determined by counters in an integrated circuit (IC). Typically, two LPG controllers are alternately activated to generate two alternating control signals for driving two LEDs. However, the method for driving two LEDs has two disadvantages: (1) one more LPG controller is required and thus increases circuit complexity; and (2) time intervals between the two alternating control signals are determined by respective activation timing of the LPG controllers and thus cannot be controlled precisely.

BRIEF SUMMARY OF THE INVENTION

One embodiment of the present invention provides a light driving device, which comprises a signal generator, a demultiplexer and a first light driving circuit and a second light driving circuit. The signal generator generates a signal. The demultiplexer converts the signal to a first control signal and a second control signal. The first and second light driving circuits are respectively controlled by the first and second control signals.

Another embodiment of the present invention provides a light driving device, which comprises a signal generator, a demultiplexer and a first light driving circuit and a second light driving circuit. The signal generator generates a signal. The demultiplexer comprises a D flip-flop for converting the signal to a first control signal and a second control signal. The first and second light driving circuits are respectively controlled by the first and second control signals.

Another embodiment of the present invention provides a light driving method, which comprises generating a signal, converting the signal to a first control signal and a second control signal, and controlling two lights according to the first control signal and the second control signal.

Compared with a traditional light driving device in which one LPG pin only controls one light emitting diode, the light driving device according to the present invention controls more than one light emitting diode with one LPG pin such that LPG pins can be saved. In addition, flashing duty cycles of the light emitting diodes can be controlled by setting the period and duty cycle of one LPG signal in software associated with the light driving device.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
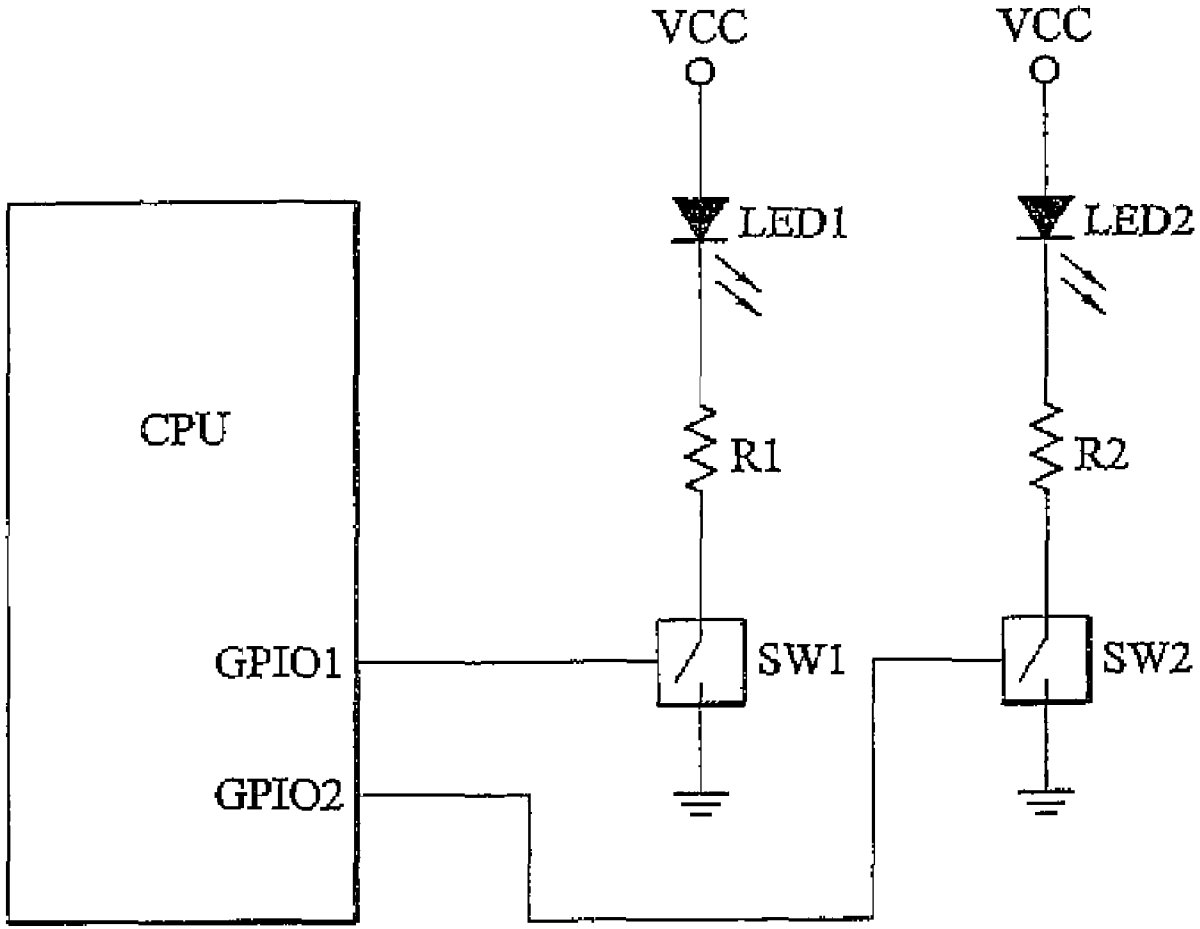
FIG. 1 (PRIOR ART)
FIG. 1 is a circuit diagram of a conventional light driving device.
Figure 2:
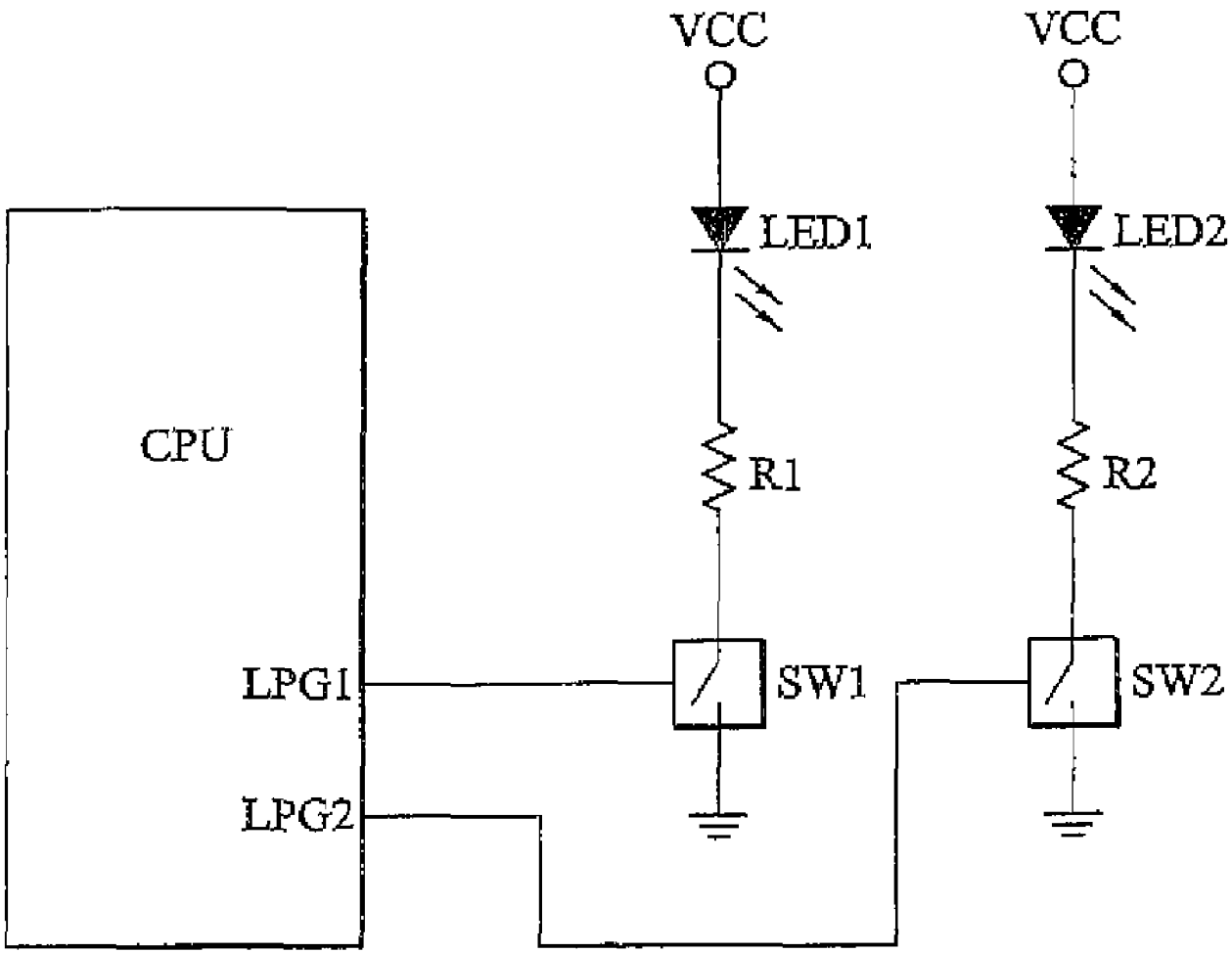
FIG. 2 (PRIOR ART)
FIG. 2 is a circuit diagram of a conventional light driving device.
Figure 3:
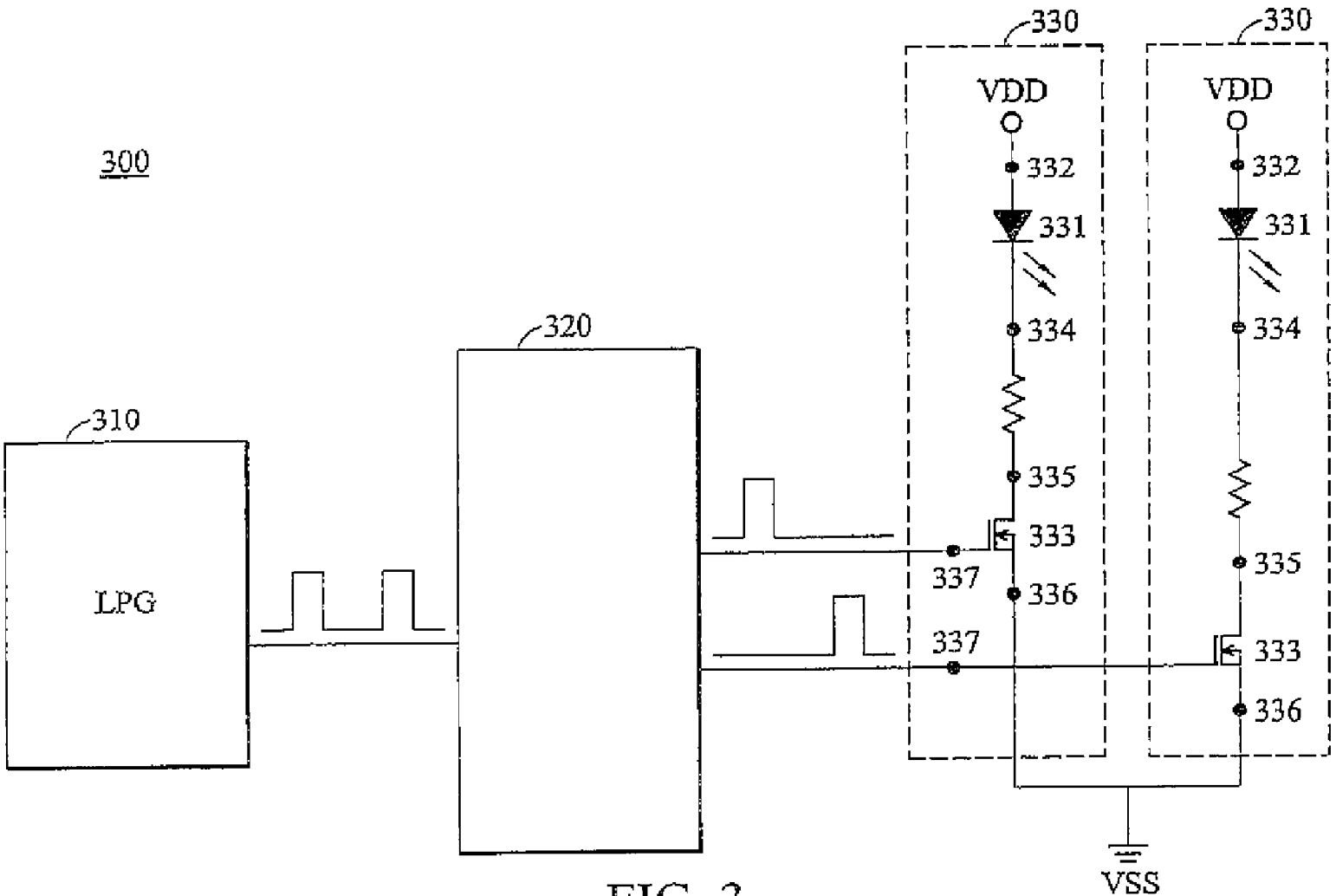
FIG. 3 is a block diagram of a light driving device according to one embodiment of the invention.

FIG. 3 is a block diagram of a light driving device according to one embodiment of the invention. The light driving device 300 comprises a signal generator 310, a demultiplexer 320 and at least one light driving circuit 330. The signal generator 310 generates a signal. The demultiplexer 320 converts the signal to at least one control signal. The light driving circuits 330 are controlled by the control signals. Preferably, the signal generator 310 is an LED pulse generator (LPG) which generates an LPG signal. Each light driving circuit 330 comprises a light emitting diode 331 and a switch 333. Preferably, the switch 333 is a MOS transistor. The light emitting diode 331 has a first terminal 332 connected to a first voltage $V_{DD}$. The switch 333 has a first terminal (drain) 335 coupled to a second terminal 334 of the light emitting diode 331, a second terminal (source) 336 coupled to a second voltage $V_{SS}$, and a third terminal (gate) 337 coupled to the demultiplexer 320 for receiving the control signal. Preferably, the first voltage $V_{DD}$ and the second voltage $V_{SS}$ are respectively a power supply voltage and a ground.

Figure 4:
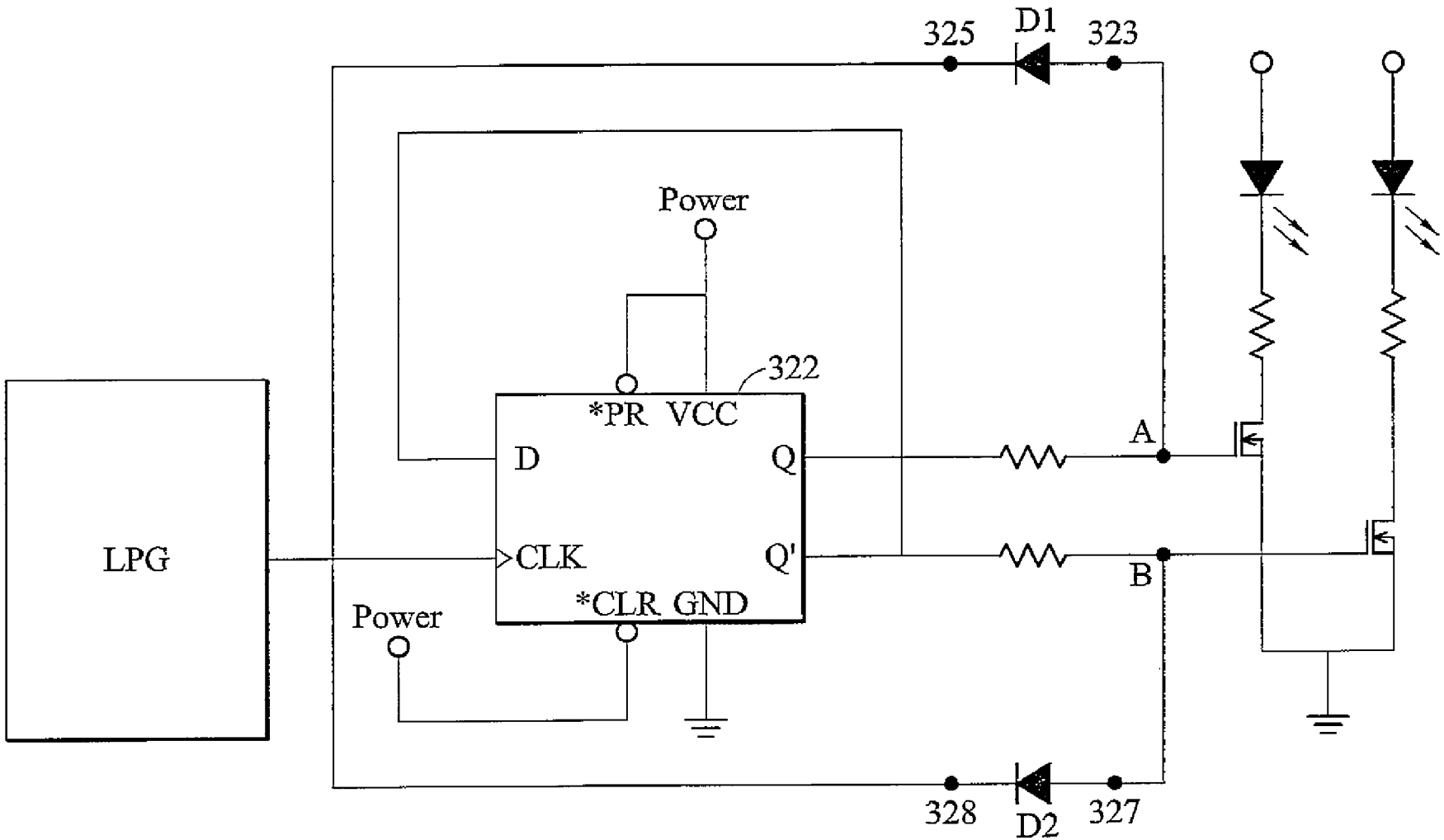
FIG. 4 is a circuit diagram of the light driving device 300 shown in FIG. 3.

FIG. 4 is a circuit diagram of the light driving device 300 shown in FIG. 3. More specifically, the demultiplexer 320 comprises a D flip-flop 322, a first diode D1 and a second diode D2. The D flip-flop 322 has a data input terminal D, a clock terminal CLK, an output terminal Q and an inverting output terminal Q'. The clock terminal CLK receives the signal. The inverting output terminal Q' outputs an output signal fed back to the data input terminal D. The output terminal and the inverting output terminal Q' respectively control the light driving circuits 330. The first diode D1 has an anode 323 coupled to the output terminal Q and a cathode 325 coupled to the clock terminal CLK. The second diode D2 has an anode 327 coupled to the inverting output terminal Q' and a cathode 328 coupled to the clock terminal CLK.

Figure 5:
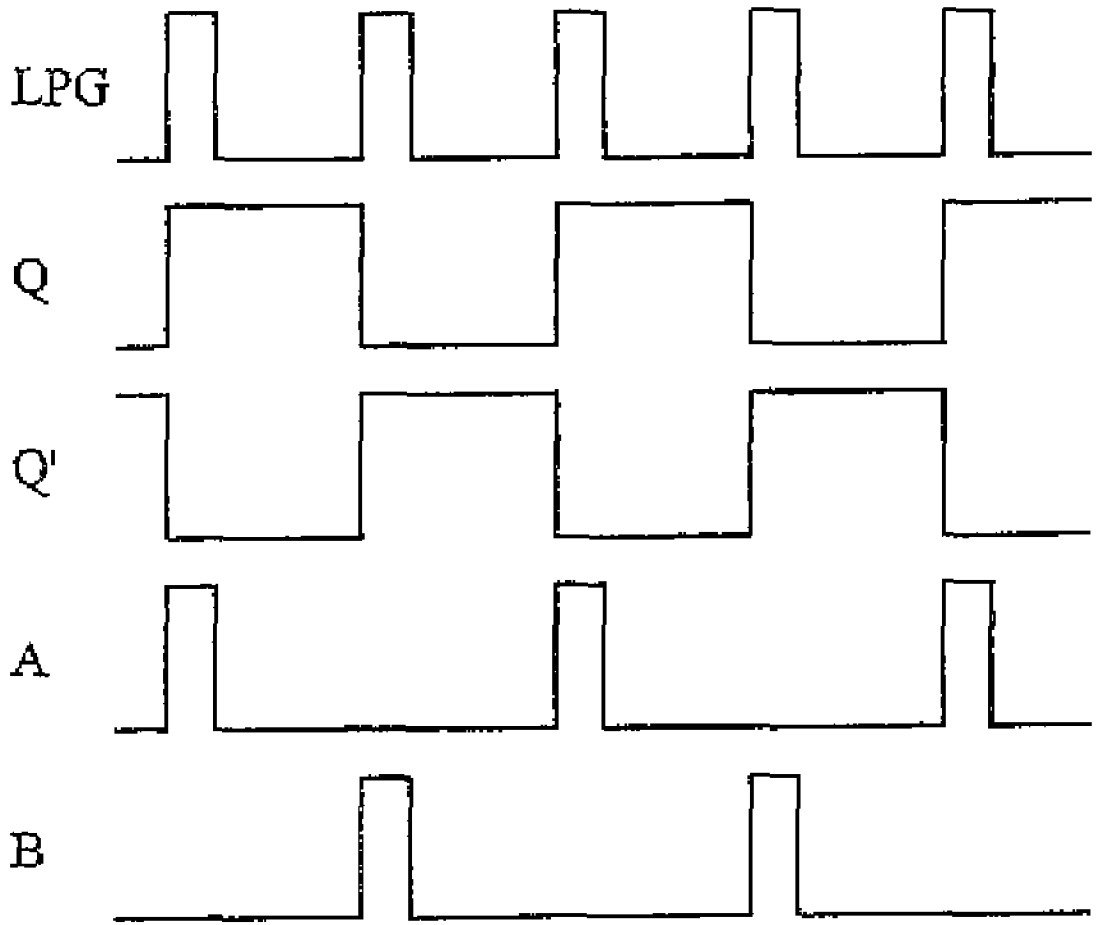
FIG. 5 is a timing diagram of signals for operation of the light driving device 300 shown in FIG. 4.

FIG. 5 is a timing diagram of signals for the operation of the light driving device 300 shown in FIG. 4. LPG represents a signal generated by the signal generator 310. Q and Q' respectively represent output signals of the output terminal Q and the inverting output terminal Q'. A and B respectively represent voltage levels of the nodes A and B shown in FIG. 4. When signals Q and Q' respectively start in low and high levels, operation of the light driving device 300 can be divided into four stages. In the first stage, when the signal LPG transits from low level to high level, the logic state of the signal Q' is then latched via the data input terminal D. As a result, the signal Q transits from low level to high level and the signal Q' transits from high level to low level. Thus, the first and second diodes D1, D2 are reverse-biased and the nodes A and B are respectively at high and low levels. In the second stage, when the signal LPG transits from high level to low level, the first diode D1 is forward biased such that the node A is pulled to low level and the node B stays in low level. In the third stage, when the signal LPG transits again from low level to high level, the logic state of the signal Q' is then latched via the data input terminal D. As a result, the signal Q transits from high level to low level and the signal Q' transits from low level to high level. Thus, the first diode D1 and the second diode D2 are reverse biased such that the node A stays in low level and the node B transits from low level to high level. In the fourth stage, when the signal LPG transits from high level to low level, the second diode D2 is forward biased such that the node B is pulled to low level and the node A still stays in low level. As a result, the four stages repeat again and again and the light emitting diodes 331 are alternately turned ON/OFF with a period twice of that of the LPG signal.

Figure 6:
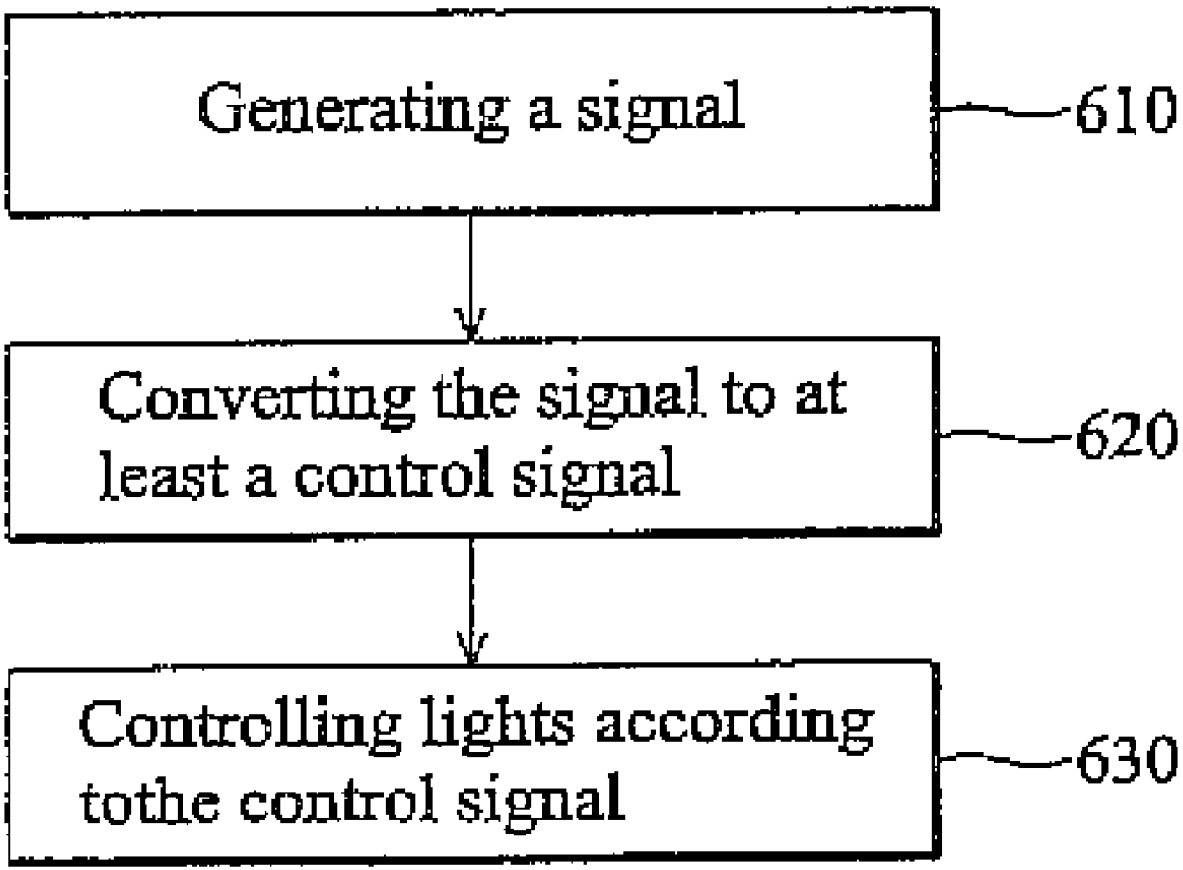
FIG. 6 is a flow chart of a light driving method for driving lights according to an embodiment of the invention.

The present invention also provides a light driving method for driving lights. As shown in FIG. 6, the method comprises generating a signal (610), converting the generated signal to a first control signal and a second control signal (620), and controlling two lights according to the first control signal and the second control signal (630). More specifically, the generated signal is an LPG signal and the lights are light emitting diodes.

Compared with a traditional light driving device in which one LPG pin only controls one light emitting diode, the light driving device according to the present invention controls more than one light emitting diode with one LPG pin such that LPG pins can be saved. In addition, flashing duty cycles of the light emitting diodes can be controlled by setting the period and duty cycle of one LPG signal in software associated with the light driving device.

While the invention has been described by way of example and in terms of preferred embodiment, it is to be understood that the invention is not limited thereto. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A light driving device, comprising:

a Light Emitting Diode (LED) pulse generator for generating a signal;

a demultiplexer comprising a D flip-flop for converting the generated signal to a first control signal and a second control signal, wherein the D flip-flop comprises:

a data input terminal;

a clock terminal for receiving the generated signal as input;

an output terminal for outputting the first control signal; and an inverting output terminal for outputting the second control signal, wherein the inverting output terminal is directly connected to the data input terminal such that the data input terminal receives the second control signal directly as input, and a first light driving circuit and a second light driving circuit that are respectively controlled by the first control signal and the second control signal;

the D flip-flop further comprising a first diode having an anode coupled to the output terminal and a cathode coupled to the clock terminal, and a second diode having an anode coupled to the inverting output terminal and a cathode coupled to the clock terminal, wherein the first light driving circuit comprises a first switch that is controlled by the first control signal to cause a first light to turn on and off; and the second light driving circuit comprises a second switch that is controlled by the second control signal to cause a second light to turn off, such that the generated signal of the LED pulse generator controls more than one light.

2. The light driving device as claimed in claim 1, wherein each of the first and second light driving circuits further comprises:

the first and second lights respectively having a first terminal connected to a first voltage, and a second terminal, wherein the first and second switches of each of the first and second light driving circuits respectively have a first terminal coupled to the second terminal of the respective first and second lights, a second terminal connected to a second voltage, and a third terminal coupled to the demultiplexer, and wherein the third terminal of the switch of the first light driving circuit receives the first control signal, and the third terminal of the switch of the second light driving circuit receives the second control signal.

3. The light driving device as claimed in claim 2, wherein the light is a light emitting diode and the switch is a MOS transistor, and wherein the first terminal of the switch is a drain, the second terminal of the switch is a source, and the third terminal of the switch is a gate.

4. The light driving device as claimed in claim 3, wherein the first and second voltages are respectively a power supply voltage and a ground.

5. The light driving device as claimed in claim 1, further comprising a first LED and a second LED, wherein the first LED and the second LED are controlled by the first light driving and the second light driving circuit, respectively, and a CPU is indirectly electrically connected to the first LED and the second LED through the LED pulse generator and the demultiplexer.

* * * * *